US011704958B2

(12) United States Patent
Li et al.

(10) Patent No.: US 11,704,958 B2
(45) Date of Patent: Jul. 18, 2023

(54) CASH STORAGE APPARATUS AND CASH RECYCLING AND PROCESSING DEVICE

(71) Applicant: SHANDONG NEW BEIYANG INFORMATION TECHNOLOGY CO., LTD., Shandong (CN)

(72) Inventors: Qiang Li, Shandong (CN); Lei Zheng, Shandong (CN); Yong Yuan, Shandong (CN); Jianyu Sun, Shandong (CN); Qiangzi Cong, Shandong (CN)

(73) Assignee: SHANDONG NEW BEIYANG INFORMATION TECHNOLOGY CO., LTD., Shandong (CN)

( * ) Notice: Subject to any disclaimer, the term of this patent is extended or adjusted under 35 U.S.C. 154(b) by 393 days.

(21) Appl. No.: 16/977,920

(22) PCT Filed: Mar. 7, 2019

(86) PCT No.: PCT/CN2019/077329
§ 371 (c)(1),
(2) Date: Sep. 3, 2020

(87) PCT Pub. No.: WO2019/174517
PCT Pub. Date: Sep. 19, 2019

(65) Prior Publication Data

US 2021/0074110 A1 Mar. 11, 2021

(30) Foreign Application Priority Data

Mar. 13, 2018 (CN) ..... 201810206519.3

(51) Int. Cl.
*G07D 11/14* (2019.01)
*G07D 11/18* (2019.01)

(52) U.S. Cl.
CPC ..... *G07D 11/14* (2019.01); *G07D 11/18* (2019.01)

(58) Field of Classification Search
CPC ..... G07D 11/13; G07D 11/14; G07D 11/18; G07D 11/40; G07D 11/125
See application file for complete search history.

(56) References Cited

U.S. PATENT DOCUMENTS 339,614 A * 4/1886 Beale ..... A47B 88/487 312/334.25
4,718,655 A 1/1988 Okayama et al.
(Continued)

FOREIGN PATENT DOCUMENTS

CN 202205259 U 4/2012
CN 102509388 A 6/2012
(Continued)

OTHER PUBLICATIONS

International Search Report issued by the State Intellectual Property Office of the P.R. China in connection with International Application No. PCT/CN2019/077329, dated May 30, 2019.

*Primary Examiner* — Jeffrey A Shapiro
(74) *Attorney, Agent, or Firm* — George Likourezos; Carter, DeLuca & Farrell LLP

(57) ABSTRACT

Provided are a cash storage apparatus and a cash recycling and processing device. The cash storage apparatus includes a cabinet and a banknote box assembly. The cabinet is provided with a first inlet/outlet at a top of the cabinet and two guiding parts inside the cabinet. The two guiding parts are arranged in a first direction at an interval. Each guiding part includes a guiding rail extending in a second direction vertical to the first direction. The guiding rail is provided with a locating part. The banknote box assembly is provided with a second inlet/outlet at a top of the banknote box assembly and two first movable parts. The two first movable parts are arranged in movable fit with the two guiding rails respectively.

15 Claims, 9 Drawing Sheets

(56) References Cited

U.S. PATENT DOCUMENTS

| | | | | |
|---|---|---|---|---|
| 2013/0307210 | A1* | 11/2013 | Takada | B65H 5/36 271/225 |
| 2014/0217669 | A1* | 8/2014 | Aoji | B65H 31/24 271/297 |
| 2019/0231071 | A1* | 8/2019 | Smith | A47B 88/407 |

FOREIGN PATENT DOCUMENTS

| | | | |
|---|---|---|---|
| CN | 203573403 | U | 4/2014 |
| CN | 205920540 | U | 2/2017 |
| CN | 107438869 | A | 12/2017 |
| CN | 107657720 | A | 2/2018 |
| CN | 206991473 | U | 2/2018 |

* cited by examiner

CASH STORAGE APPARATUS AND CASH RECYCLING AND PROCESSING DEVICE

This application claims the priority of China patent application No. 201810206519.3, which was filed with the State Intellectual Property Office of the People's Republic of China on Mar. 13, 2018 and the entirety of which is incorporated herein by reference.

TECHNICAL FIELD

The present disclosure relates to the field of financial self-service facility, such as a cash storage apparatus and a cash recycling and processing device.

BACKGROUND

The cash recycling and processing device is an integrated financial self-service facility with multiple functions such as cash recycling, deposit, withdrawal, temporary storage, sorting, counting, identification of counterfeit banknote, record of banknote serial number, continuous banknote input, daily banknote keeping and inquiry, and it can realize recycling of circulating banknotes of at least one denomination.

The cash recycling and processing device is provided with multiple banknote boxes to store banknotes of various types and denominations. In the related art, the multiple banknote boxes are generally arranged in a cabinet for banknote storage to improve the safety performance of the banknote boxes. Banknotes are put into the banknote box through a port on the cabinet of the cash storage apparatus, or the banknotes from the banknote box are output through the port on the cabinet. In case of operations such as banknote counting or feeding, the banknote box can be taken out from the cash storage apparatus.

The positioning of the banknote boxes in the cabinet of the cash storage apparatus in the related art is generally not precise enough, resulting in abnormal banknote input or output.

SUMMARY

The present disclosure provides a cash storage apparatus with precisely positioned banknote boxes in the cabinet to ensure normal banknote input or output.

The present disclosure further provides a cash recycling and processing device featured by stable and reliable operation.

In an embodiment, the present disclosure provides a cash storage apparatus, including a cabinet and a banknote box assembly.

The cabinet is provided with a first inlet/outlet at the top and two guiding parts inside; the two guiding parts are arranged in a first direction at an interval; each guiding part includes a guiding rail extending in a second direction vertical to the first direction; the guiding rail is provided with a locating part;

The banknote box assembly is provided with a second inlet/outlet at the top and two first movable parts; the two first movable parts are arranged in movable fit with the two guiding rails respectively; when the two first movable parts are in fit with the locating parts on the two guiding rails respectively after moving along the two guiding rails respectively, the banknote box assembly is in the cabinet and the second inlet/outlet is opposite to and in communication with the first inlet/outlet.

In an embodiment, the present disclosure further provides a cash recycling and processing device, including the said cash storage apparatus.

In the figure: 10—cash storage apparatus; 100—cabinet; 110—door; 120—first inlet/outlet; 130—guiding part; 131—first side wall; 132—second side wall; 133—third side wall; 134—fourth side wall; 135—sliding slot; 136—guiding rail; 137—locating part; 138—slope; 140—fixed sliding rail; 200—banknote box assembly; 210—frame; 212—movable sliding rail; 214—second movable part; 220—banknote box; 222—second inlet/outlet; 223—first movable part; 224—first roller; 225—circular slot; 226—sliding block; 227—slot; 300—first direction; 310—second direction; 320—third direction; 30—cash recycling and processing device; 31—input device; 32—output device; 20—temporary storage device; 33—identification device; 34—recycling box; 35—recovering box; 36—checking box.

DETAILED DESCRIPTION

The embodiments described here are some of rather than all of the embodiments of the present disclosure.

In the absence of conflict, the embodiments of the present disclosure can be combined with the features and technical solutions in the embodiments.

Similar numbers and letters refer to similar items in the following drawings. Therefore, if a feature is defined in one drawing, such feature will not be defined or explained in the subsequent drawings.

In the descriptions of the present disclosure, the words such as "first" and "second" are only used for distinguishing the descriptions, and cannot be understood as indicating or implying relative importance.

Embodiment I

Figure 1:
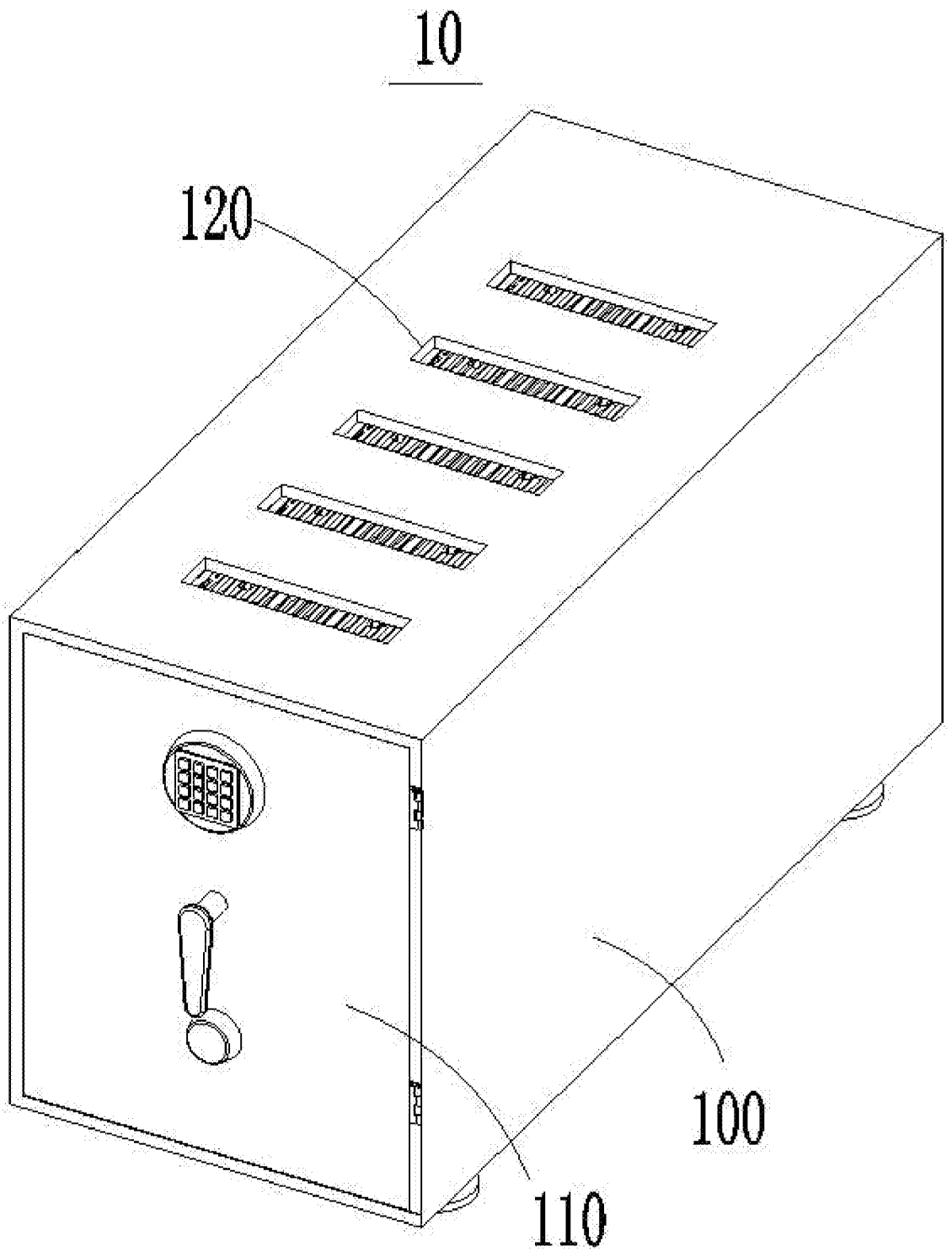
FIG. 1 is an external structural view of a cash storage apparatus according to an embodiment of the present disclosure.
Figure 2:
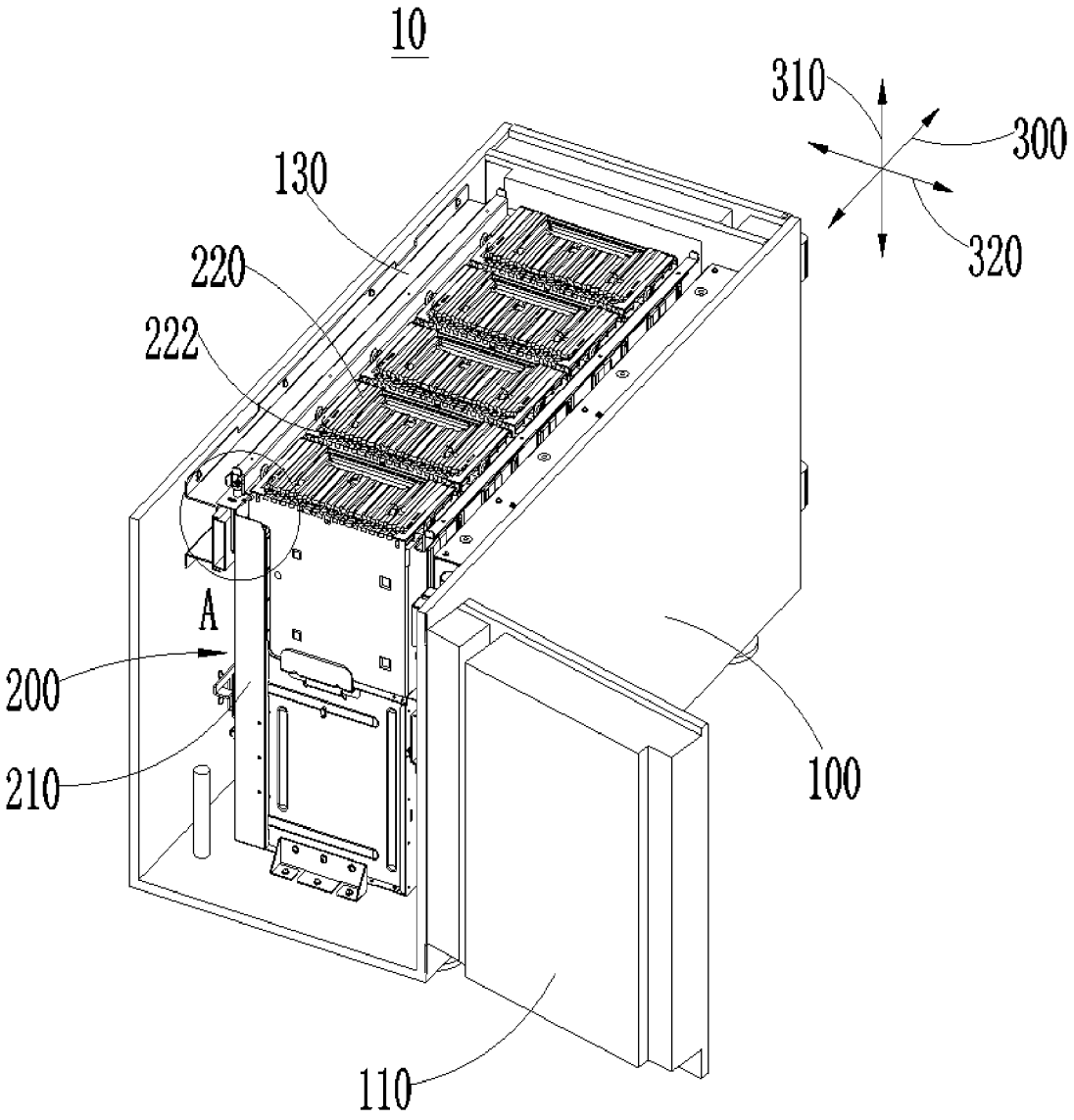
FIG. 2 is an internal structural view of a cash storage apparatus according to an embodiment of the present disclosure.
Figure 3:
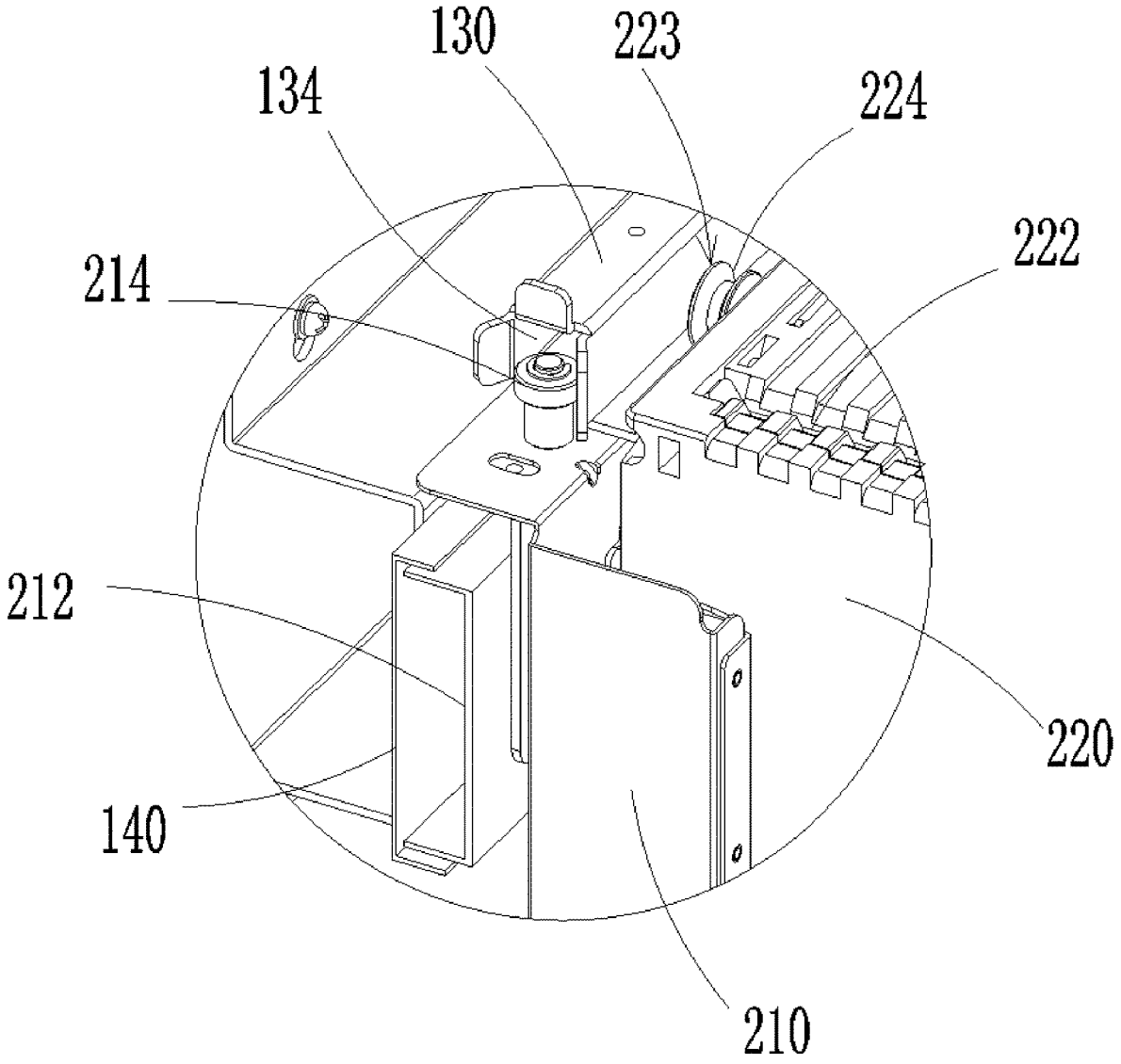
FIG. 3 is an enlarged view of part A in FIG. 2.

FIG. 1 is an external structural view of a cash storage apparatus 10 according to an embodiment of the present disclosure. FIG. 2 is an internal structural view of a cash storage apparatus 10 according to an embodiment of the present disclosure. FIG. 3 is an enlarged view of part Ain FIG. 2. As shown in FIG. 1, FIG. 2 and FIG. 3, the embodiment of the present disclosure provides a cash storage apparatus 10 for banknote input, storage and output. The cash storage apparatus 10 includes a cabinet 100 and a banknote box assembly 200.

The front of cabinet 100 is provided with a door 110 which can be opened and closed for the installation and removal of the banknote box assembly 200. The cabinet 100 is provided with at least one first inlet/outlet 120 at the top. In the embodiment, multiple first inlet/outlets 120 can be arranged; each first inlet/outlet 120 is in the shape of strip and extends in a first direction 300; the multiple first inlet/outlets 120 are arranged at an interval in a second direction 310; the second direction 310 is vertical to the first direction 300. In other embodiments, only one first inlet/outlet 120 may be provided.

The cabinet 100 is provided with two guiding parts 130 inside. The two guiding parts 130 are arranged at an interval in the first direction 300. The two guiding parts 130 can be arranged at different positions as required. In the embodiment, the two guiding parts 130 can be arranged inside the top wall of the cabinet 100, respectively. In other embodiments, the two guiding parts 130 can be arranged inside the left side wall and the right side wall of the cabinet 100, respectively.

Figure 4:
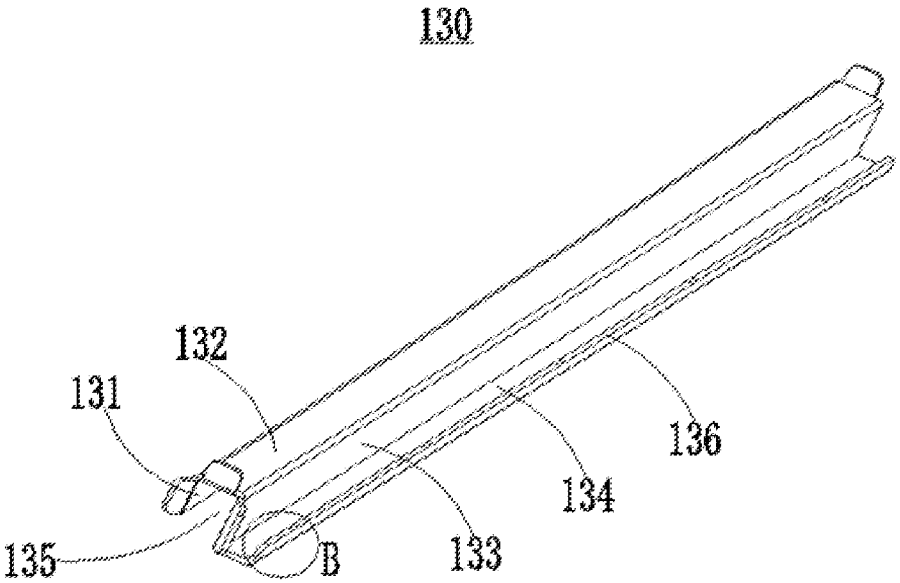
FIG. 4 is a structural view of a guiding part according to an embodiment of the present disclosure.
Figure 5:
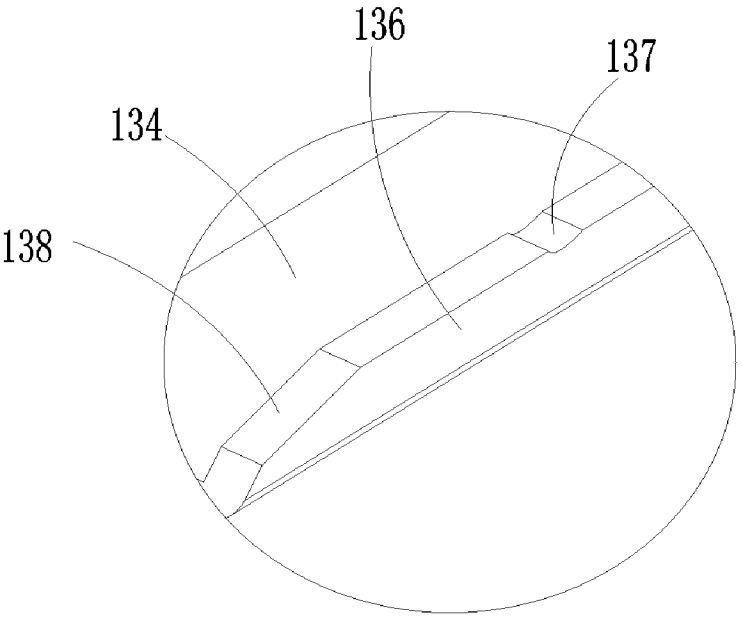
FIG. 5 is an enlarged view of part B in FIG. 4.

The guiding part 130 may be provided in different structural types as required. FIG. 4 is a structural view of a guiding part 130 according to an embodiment of the present disclosure. FIG. 5 is an enlarged view of part B in FIG. 4. As shown in FIG. 4 and FIG. 5, in the embodiment, one guiding part 130 of the two guiding parts 130 includes a first side wall 131, a second side wall 132, a third side wall 133 and a fourth side wall 134 connected in sequence. The first side wall 131 and the third side wall 133 are arranged at an interval in the first direction 300. The first side wall 131, the second side wall 132 and the third side wall 133 jointly form a sliding slot 135. The side of the fourth side wall 134 away from the sliding slot 135 is provided with a guiding rail 136. The sliding slot 135 and the guiding rail 136 extend in the second direction 310. In an embodiment, the other guiding part 130 of the two guiding parts 130 is basically the same as the said guiding part 130, except that the other guiding part 130 is not provided with the first side wall 131.

The guiding rail 136 is provided with a slope 138 and a locating part 137. The slope 138 is arranged at the end of the guiding rail 136 near the door 110. The locating part 137 is arranged for the positioning of the banknote box assembly 200 in the cabinet 100. In the embodiment, multiple locating part 137 can be provided and the multiple locating parts 137 arranged on the guiding rail 136 at an interval in a second direction 310. In other embodiments, only one locating part 137 may be provided. The locating parts 137 may be provided in different structural types as required. In the embodiment, the locating part 137 is an arc-shaped locating slot.

Figure 9:
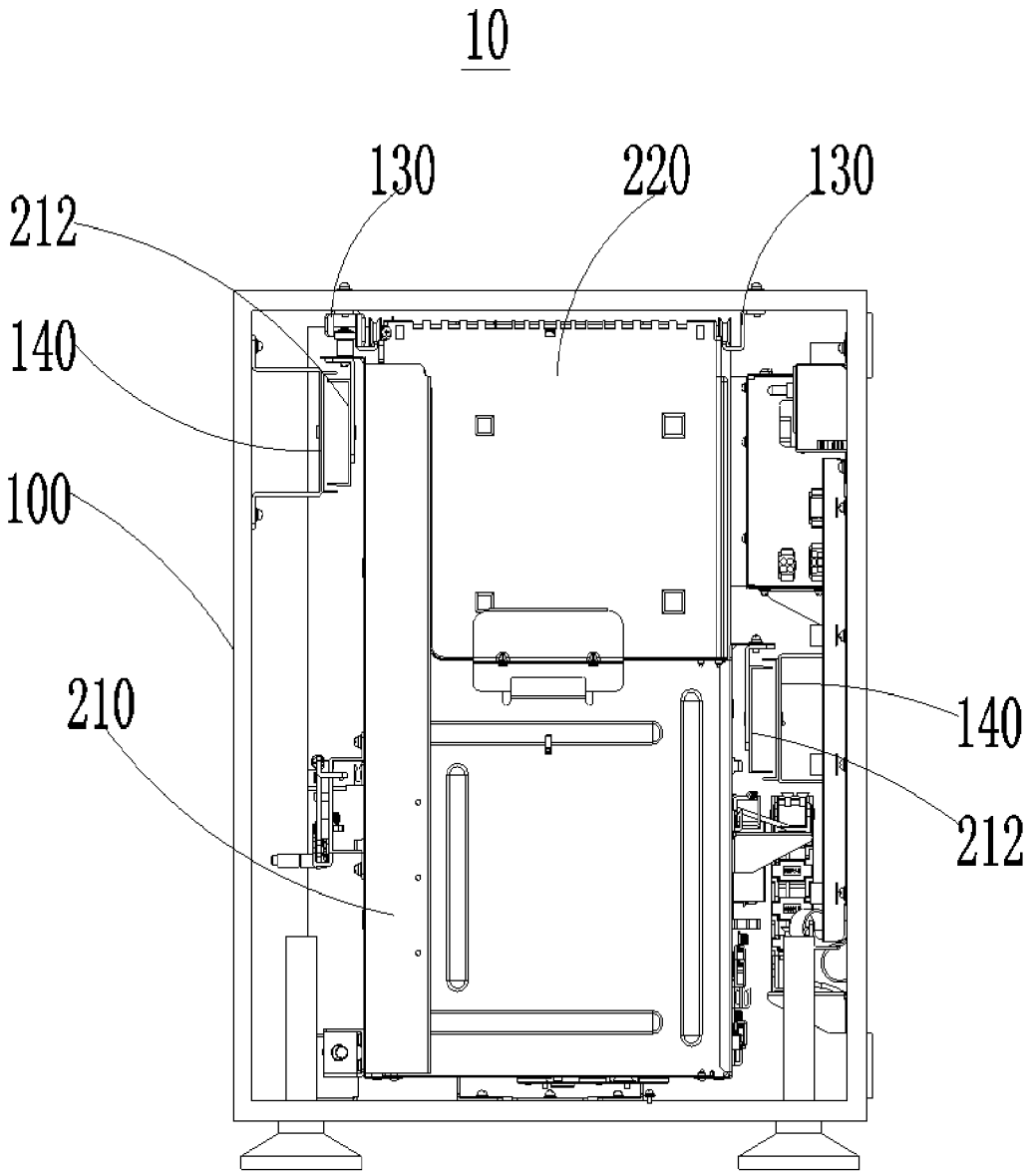
FIG. 9 is an internal structural view of a cash storage apparatus from another angle of view according to an embodiment of the present disclosure.

FIG. 9 is an internal structural view of a cash storage apparatus 10 from another angle of view according to an embodiment of the present disclosure. As shown in FIG. 9, the cabinet 100 is further provided with two fixed sliding rails 140 inside. The two fixed sliding rails 140 are arranged at an interval in the first direction 300. Each fixed sliding rail 140 extends in the second direction 310. In the embodiment, the two fixed sliding rails 140 are arranged inside the left side wall and the right side wall of the cabinet 100, respectively. In other embodiments, the two fixed sliding rails 140 may be arranged inside the bottom wall of the cabinet 100, respectively. The fixed sliding rail 140 may be provided in different structural types as required. In the embodiment, the cross section of the fixed sliding rail 140 is U-shaped. In other embodiments, the cross section of the fixed sliding rail 140 may be in other shapes, such as V-shape.

Figure 8:
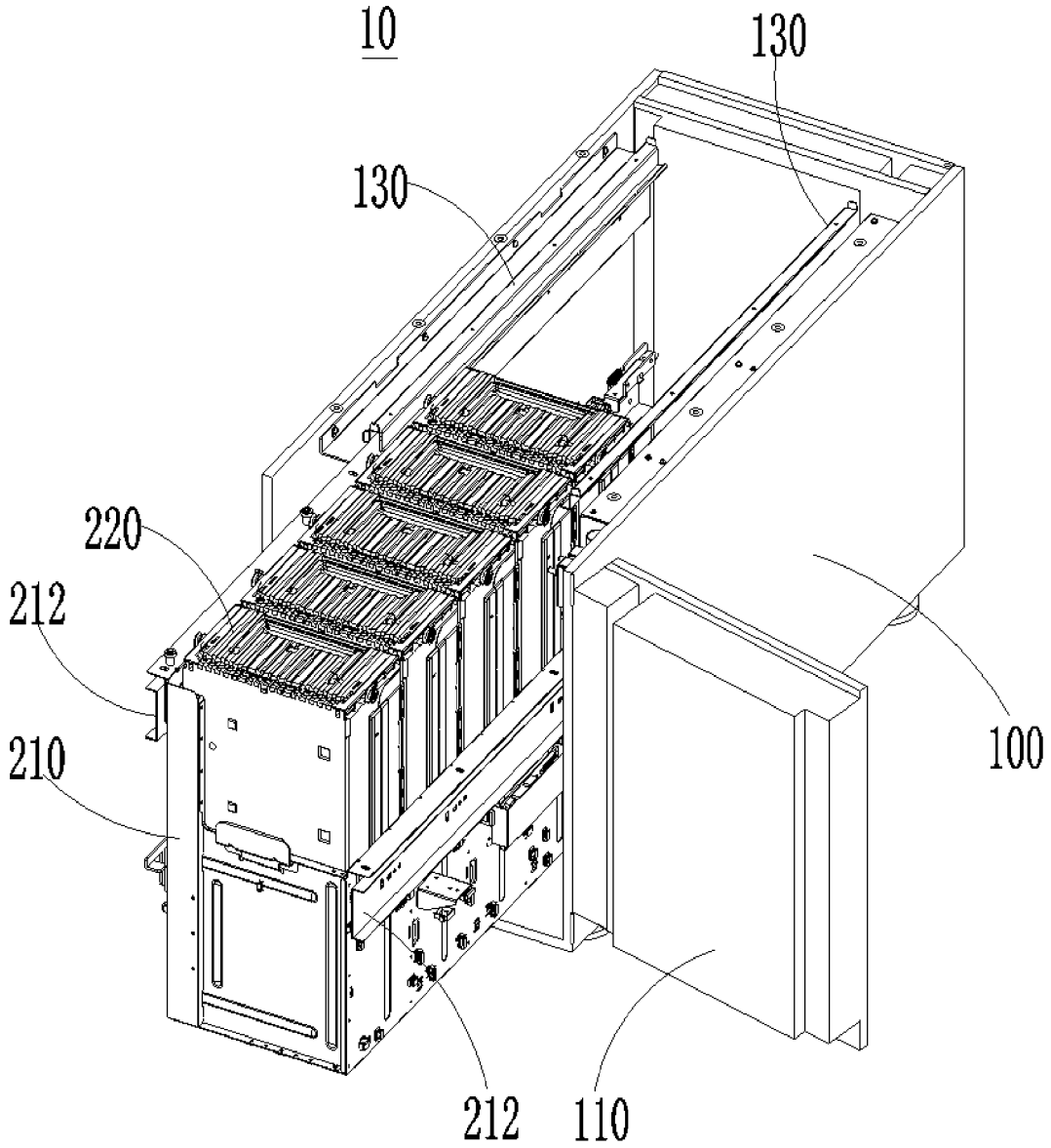
FIG. 8 is an assembling view of a banknote box assembly and a cabinet according to an embodiment of the present disclosure.

FIG. 8 is an assembling diagram of a banknote box assembly 200 and a cabinet 100 according to an embodiment of the present disclosure. As shown in FIG. 2 and FIG. 8, the banknote assemblies 200 may be provided in different structural types as required. In the embodiment, the banknote box assembly 200 includes a frame 210 and multiple banknote boxes 220 installed in the frame 210. The multiple banknote boxes 220 are arranged in sequence in the frame 210 in the second direction 310. In other embodiments, the banknote box assembly 200 may only include banknote box 220, and only one banknote box 220 may be provided.

As shown in FIG. 2 and FIG. 3, the banknote box assembly 200 is provided with at least one second inlet/outlet 222 at the top. The number of the second inlet/outlet 222 is the same as the number of the first inlet/outlet 120. In an embodiment, the inlet/outlet 222 is arranged at the top of the banknote box 220. In the embodiment, multiple second inlet/outlets 222 are provided. Each second inlet/outlet 222 is in the shape of strip and extends in a first direction 300. The multiple second inlet/outlets 222 are arranged at an interval in the second direction 310 for matching with the multiple first inlet/outlets 120. In an embodiment, multiple second inlet/outlets 222 correspond to multiple banknote boxes 220 one-to-one. The multiple second inlet/outlets 222 are arranged at the top of the multiple banknote boxes 220, which means that each banknote box 220 is only provided with one second inlet/outlet 222. In other embodiments, in case that only one first inlet/outlet 120 is arranged, only one second inlet/outlet 222 may be provided; each banknote box 220 may also be provided with multiple second inlet/outlets 222.

Figure 7:
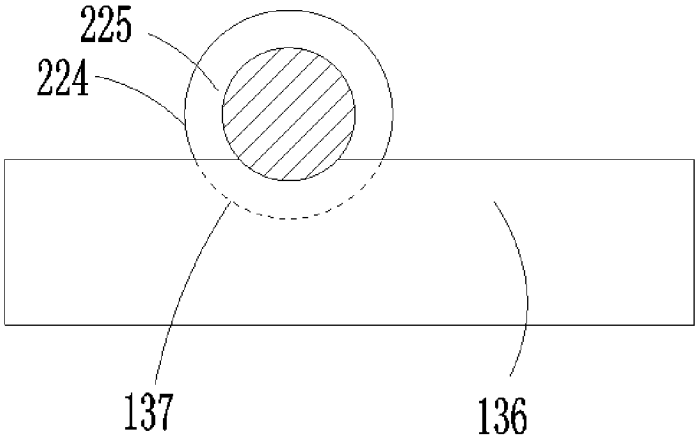
FIG. 7 is a schematic view of a first movable part in fit with a guiding rail from a second angle of view according to an embodiment of the present disclosure.
Figure 6:
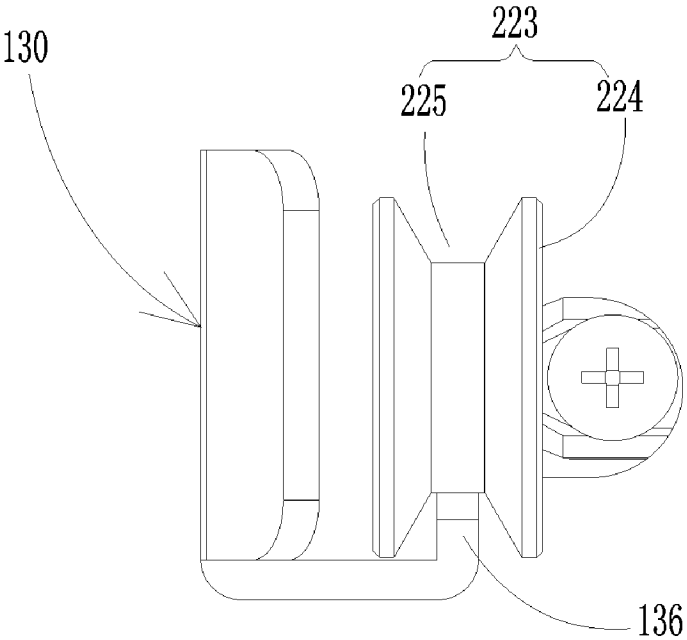
FIG. 6 is a schematic view of a first movable part in fit with a guiding rail from a first angle of view according to an embodiment of the present disclosure.

FIG. 6 is a schematic diagram of a first movable part 223 in fit with a guiding rail 136 from a first angle of view according to an embodiment of the present disclosure. FIG. 7 is a schematic diagram of a first movable part 223 in fit with a guiding rail 136 from a second angle of view according to an embodiment of the present disclosure. As shown in FIG. 2 to FIG. 8, the banknote box assembly 200 is provided with two first movable parts 223. The two first movable parts 223 are arranged in movable fit with the two guiding rails 136 respectively. The first movable part 223 can climb the corresponding guiding rail 136 under the guidance of a slope 138. When the two first movable parts 223 are in fit with the locating parts 137 on the two guiding rails 136 respectively after moving along the two guiding rails 136 respectively, the banknote box assembly 200 is in the cabinet 100 and the second inlet/outlet 222 is opposite to and in communication with the first inlet/outlet 120. In this way, the banknote box assembly 200 is installed in place.

The first movable parts 223 can be arranged at different positions as required. In the embodiment, the two first movable parts 223 can be respectively arranged on both sides of the banknote box 220, so that the second inlet/outlet 222 can be precisely opposite to and in communication with the first inlet/outlet 120. In other embodiments, the two first movable parts 223 may be arranged on the two opposite sides of the frame 210, or one first movable part 223 is arranged in the banknote box 220 and the other is arranged on the frame 210.

The first movable parts 223 may be provided in different structural types as required. As shown in FIG. 6 and FIG. 7, in the embodiment, the first movable part 223 comprises a first roller 224. The first roller 224 is provided with a circular slot 225 in fit with the guiding rail 136. The first roller 224 is arranged in rolling fit with the guiding rail 136 by the circular slot 225. In an embodiment, the circular slot 225 rides on the guiding rail 136. The width of the circular slot 225 in the first direction 300 is in fit with the thickness of the guiding rail 136. Under the action of its own gravity, the first roller 224 butts with the guiding rail 136 in the third direction 320 to limit the position of the banknote box assembly 200 in the second direction 310 and the third direction 320, so that the box assembly 200 can only move in the first direction 300 when it is in the cabinet 100. The third direction 320 is vertical to the first direction 300 and the second direction 310 at the same time. When the first roller 224 is in fit with the locating part 137 (namely the locating slot) after rolling along the guiding rail 136, the position of the banknote box assembly 200 in the first direction 300 is limited. In this way, the banknote box assembly 200 is stably positioned in the cabinet 100, and the second inlet/outlet 222 is opposite to and in communication with the first inlet/outlet 120. In an embodiment, the cross section of the circular slot 225 is A-shaped, so that the first roller 224 can ride on the guiding rail 136.

In the embodiment, each first movable part 223 includes multiple rollers 224. The multiple first rollers 224 are arranged on the banknote box 220 at an interval in the second direction 310 for one-to-one corresponding to and matching with the multiple locating parts 137 on the corresponding guiding rail 136. In other embodiments, when the guiding rail 136 corresponding to the first movable part 223 is only provided with one locating part 137, each movable part 223 may be provided with only one first roller 224.

As shown in FIG. 3 and FIG. 4, the banknote box assembly 200 is also provided with a second movable part 214. The second movable part 214 is arranged in movable fit in the sliding slot 135. The second movable part 214 is arranged in rolling or sliding fit with the first side wall 131 and the third side wall 133 at the same time when the second movable part 214 is in moving fit in the sliding slot 135.

The second movable parts 214 can be arranged in different positions as required. In the embodiment, the second movable part 214 is arranged on the frame 210. In other embodiments, the second movable part 214 may be arranged on the banknote box 220. The second movable parts 214 may be provided in different structural types as required. In the embodiment, the second movable part 214 is a second roller arranged in rolling fit in the sliding slot 135, and the second roller is in rolling fit with the first side wall 131 and the third side wall 133. In an embodiment, the second movable part 214 can also be a sliding block in sliding fit with the sliding slot 135. The fit clearance between the first movable part 223 and the guiding rail 136 can be widened by arranging the second movable part 214 in fit with the sliding slot 135, so that the banknote box assembly 200 can be installed on the cabinet 100.

As shown in FIG. 8 and FIG. 9, the banknote box assembly 200 is also provided with two movable sliding guiding rails 212. The two movable sliding rails 212 can be arranged at different positions as required. In the embodiment, the two movable sliding rails 212 are arranged on the left side wall and the right side wall of the frame 210 respectively. In other embodiments, the two movable sliding rails 212 may be arranged at the bottom wall of the frame 210.

The two movable sliding rails 212 may be provided with different structural types as required. In the embodiment, the cross section of the two movable sliding rails 212 is U-shaped. In other embodiments, the cross section of the two movable sliding rails 212 may be V-shaped. The two movable sliding rails 212 are in sliding fit with the two fixed sliding rails 140 respectively, to improve the stability of the banknote box assembly 200 when it slides in the cabinet 100.

The cash storage apparatus 10 includes the cabinet 100 and the banknote box assembly 200. The cabinet 100 is provided with the first inlet/outlet 120 at the top; the cabinet 100 is provided with two guiding parts 130 inside. The two guiding parts 130 are arranged at an interval in the first direction 300. The guiding part 130 includes the guiding rail 136. The guiding rail 136 extends in the second direction 310. The second direction 310 is vertical to the first direction 300. The guiding rail 136 is provided with the locating part 137. The banknote box assembly 200 is provided with the second inlet/outlet 222 at the top. The banknote box assembly 200 is provided with two first movable parts 223. The two first movable parts 223 are arranged in moving fit with the two guiding rails 136. When the two first movable parts 223 are in fit with the locating parts 137 on the two guiding rails 136 respectively after moving along the two guiding rails 136 respectively, the banknote box assembly 200 is in the cabinet 100 and the second inlet/outlet 222 is opposite to and in communication with the first inlet/outlet 120 for normal banknote input and output through the first inlet/outlet 120 and the second inlet/outlet 222. That is, the cash storage apparatus 10 can realize precise positioning of the banknote box 220 in the cabinet 100 to ensure normal banknote input and output and to effectively reduce the defect of the related cash storage apparatus 10.

Embodiment II

Figure 11:
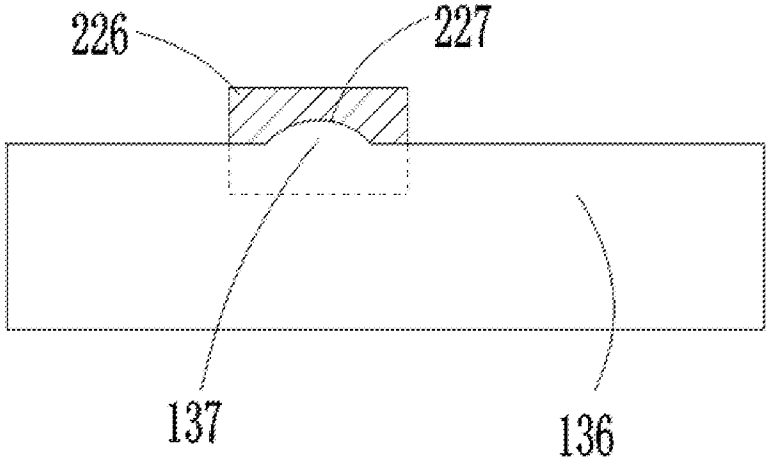
FIG. 11 is a schematic view of a first movable part of another structural form in fit with a guiding rail from a second angle of view according to an embodiment of the present disclosure.
Figure 10:
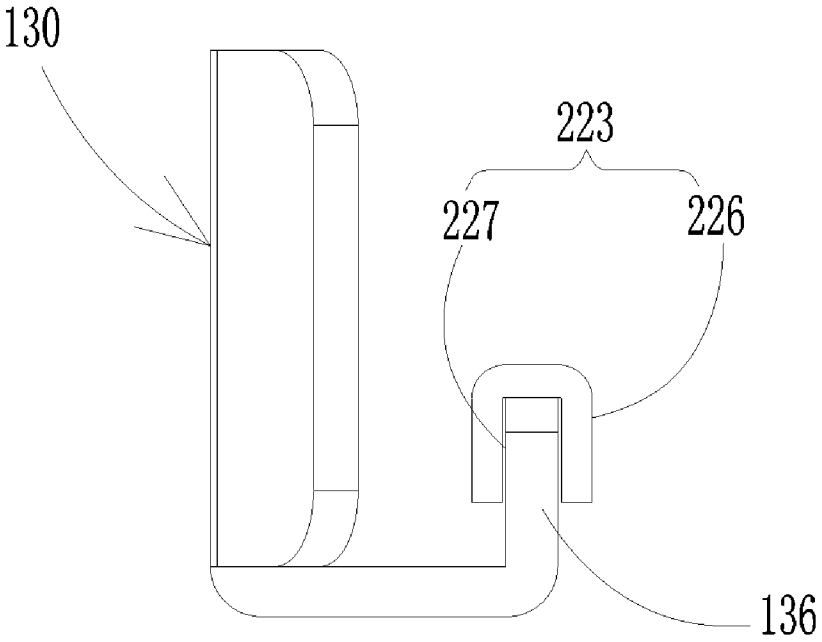
FIG. 10 is a schematic view of a first movable part of another structural form in fit with a guiding rail from a first angle of view according to an embodiment of the present disclosure.

FIG. 10 is a schematic diagram of another first movable part 223 in fit with a guiding rail 136 from a first angle of view according to an embodiment of the present disclosure. FIG. 11 is a schematic diagram of a first movable part 223 of another structural form in fit with a guiding rail 136 from a second angle of view according to an embodiment of the present disclosure. As shown in FIG. 10 and FIG. 11, the embodiment provides a cash storage apparatus 10. The global structure, working principle and effect of the cash storage apparatus 10 are basically the same as those of the cash storage apparatus 10 in Embodiment I, except for the structures of the locating part 137 and the first movable part 223.

In the embodiment, the locating part 137 is a locating boss. The first movable part 223 includes a sliding block 226. The sliding block 226 is provided with a slot 227 for matching with the guiding rail 136. The sliding block 226 is arranged in sliding fit with the guiding rail 136 by the slot 227. When the sliding block 226 is in fit with the locating boss after sliding along the guiding rail 136 to the slot 227, the banknote box assembly 200 is in the cabinet 100 and the first inlet/outlet 120 is opposite to and in communication with the first inlet/outlet 222.

Embodiment III

Figure 12:
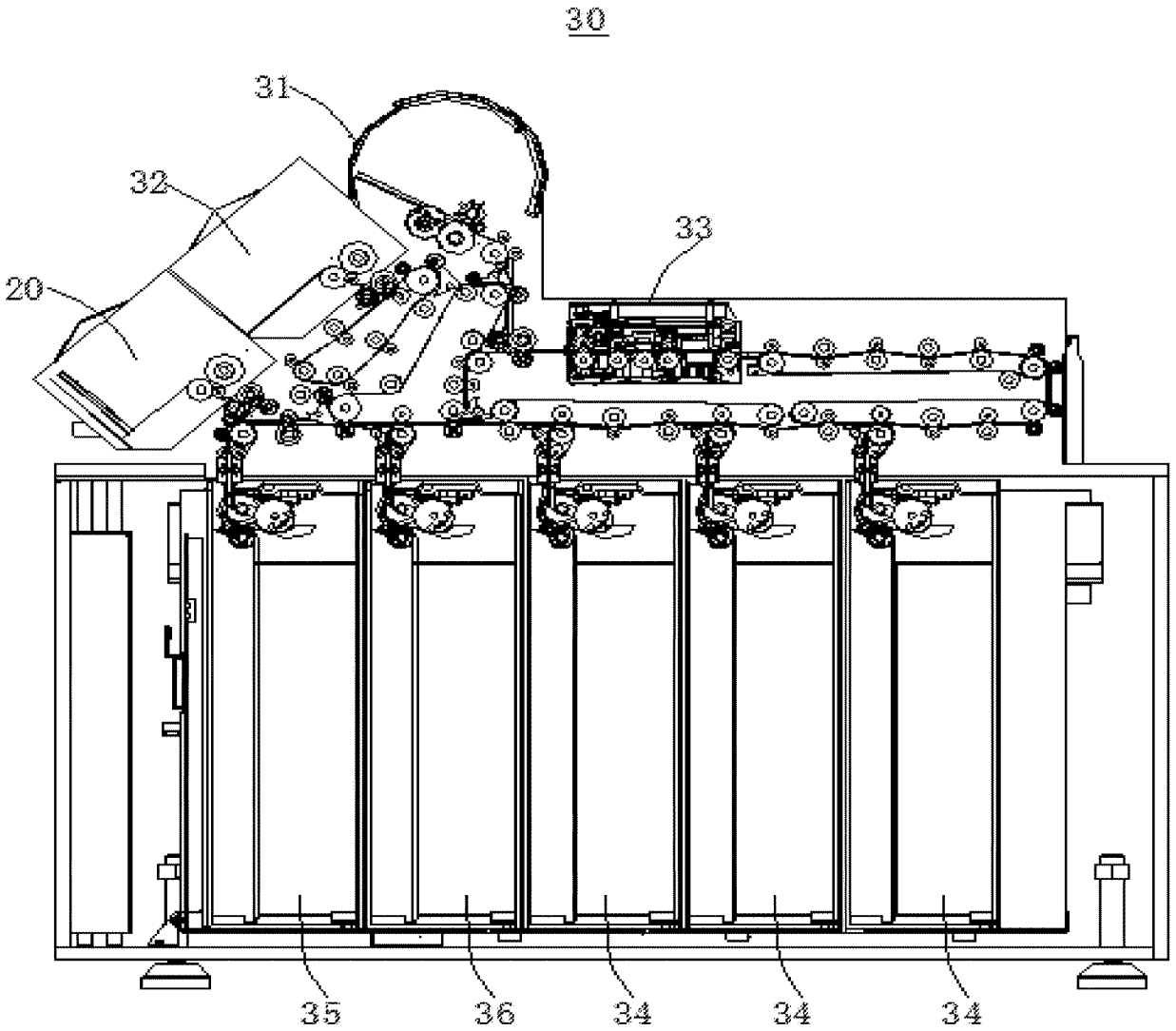
FIG. 12 is a structural view of a cash recycling and processing device according to an embodiment of the present disclosure.

FIG. 12 is a structural view of a cash recycling and processing device 30 according to an embodiment of the present disclosure. As shown in FIG. 12, the embodiment provides a cash recycling and processing device 30 including an input device 31, an output device 32, a temporary storage device 20, an identification device 33 and a cash storage apparatus 10 according to any one of the above embodiments. The above device can switch the position of banknotes through a passage.

The cash storage apparatus 10 includes a recycling box 34, a recovering box 35 and a checking box 36.

The identification device 33 can identify genuine banknotes, counterfeit banknotes, banknotes available for circulating and banknotes not available for circulating, and it also can count the banknotes.

In the embodiments, three recycling boxes 34 are provided. In other embodiments, the number of the recycling boxes 34 is not limited.

The cash recycling and processing device 30 according to the embodiment can be used for deposit, withdrawal and checking.

The embodiment of the present disclosure provides a method for deposit:

After the user puts banknotes on the supporting plate of the input device 31 and the banknotes are conveyed to the identification device 33 through the banknote input passage, the identification device 33 identifies the banknotes; the identified genuine banknotes are conveyed to the temporary storage device 20, and the identified unacceptable banknotes are conveyed to the output device 32. After the user confirms the deposit, the banknotes in the temporary storage device 20 are conveyed to the identification device 33 again. After identification, the banknotes available for circulating are eventually conveyed to the recycling box 34, and the banknotes not available for circulating are conveyed to the recovering box 35.

The embodiment of the present disclosure provides a method for withdrawal:

After the user confirms the withdrawal, the banknotes will be conveyed to a passage from the banknote recycling box 34. The banknotes are identified by the identification device 33 first. The banknotes available for circulating are conveyed to the output device 32, and the banknotes not available for circulating are conveyed to the banknote recovering device 35.

The embodiment of the present disclosure provides a method for checking:

The banknotes in one recycling box 34 of the multiple recycling boxes 34 are conveyed to the identification device 33 through a passage. The identification device 33 counts the banknotes in the recycling box 34 and sends the counted banknotes to the checking box 36. After the counting of all the banknotes in the recycling box 34, the checking box 36 returns the banknotes to the recycling box 34 through the passage.

The embodiment of the present disclosure provides another method for checking:

All the banknotes in one recycling box 34 of the multiple recycling boxes 34 are conveyed to the checking box 36 through a passage. Then the banknotes are orderly conveyed to the identification device 33 through the passage. The banknotes are conveyed to the corresponding recycling box 34 after being counted by the identification device 33.

The embodiment provides a cash recycling and processing device 30 including a cash storage apparatus 10 according to Embodiment I or Embodiment II. The recycling device is featured by stable and reliable operation to effectively reduce the defect of the related cash recycling and processing device.

What is claimed is:

1. A cash storage apparatus, comprising:

a cabinet provided with a first inlet/outlet at a top of the cabinet and two guiding parts inside the cabinet; wherein the two guiding parts are arranged in a first direction at an interval, and each guiding part comprises a guiding rail extending in a second direction; the second direction is vertical to the first direction; and the guiding rail is provided with a locating part; and a banknote box assembly provided with a second inlet/outlet at a top of the banknote box assembly and provided with two first movable parts arranged in movable fit with the two guiding rails respectively; wherein when the two first movable parts are in fit with the locating parts on the two guiding rails respectively after moving along the two guiding rails respectively, the banknote box assembly is in the cabinet and the second inlet/outlets is opposite to and in communication with the first inlet/outlet;

wherein the banknote box assembly comprises a frame and a banknote box installed in the frame; the two first movable parts are arranged on the two opposite sides of the banknote box, respectively; the second inlet/outlet is arranged on the top of the banknote box;

wherein one guiding part of the two guiding parts further comprises a sliding slot extending in the second direction; the banknote box assembly is further provided with a second movable part; the second movable part is arranged in movable fit in the sliding slot;

wherein the guiding part further comprises a first side wall, a second side wall, a third side wall and a fourth side wall connected in sequence; the first side wall, the second side wall and the third side wall jointly form the sliding slot; the guiding rail is arranged on the side of the fourth side wall away from the sliding slot; and the second side wall and the fourth side wall are arranged in a third direction at an interval, the third direction is vertical to the first direction and the second direction at the same time.

2. The apparatus according to claim 1, wherein the locating part is a locating slot; the first movable part comprises a first roller; the first roller is provided with a circular slot for fitting with the guiding rail; the first roller is arranged in rolling fit with the guiding rail through the circular slot; when the first roller is in fit with the locating slot after rolling along the guiding rail, the banknote box assembly is in the cabinet and the second inlet/outlet is opposite to and in communication with the first inlet/outlet.

3. The apparatus according to claim 1, wherein the locating part is a locating boss; the first movable part comprises a sliding block; the sliding block is provided with a slot for fit with the guiding rail; the sliding block is arranged in sliding fit with the guiding rail by the slot; when the sliding block is in fit with the locating boss after sliding along the guiding rail, the banknote box assembly is in the cabinet and the first inlet/outlet is opposite to and in communication with the second inlet/outlet.

4. The apparatus according to claim 1, wherein the first side wall and the third side wall are arranged in the first direction at an interval; the second movable part is arranged in rolling or sliding fit with the first side wall and the third side wall at the same time when the second movable part is movably fitting with the sliding slot.

5. The apparatus according to claim 1, wherein the second movable part comprises a second roller arranged on the frame; the second roller is in rolling fit with the first side wall and the third side wall at the same time.

6. The apparatus according to claim 1, wherein the guiding rail is further provided with a slope; the slope is arranged to guide the first movable part to climb the guiding rail.

7. A cash recycling and processing device, comprising a cash storage apparatus, wherein the cash storage apparatus comprises:

a cabinet provided with a first inlet/outlet at a top of the cabinet and two guiding parts inside the cabinet; wherein the two guiding parts are arranged in a first direction at an interval, and each guiding part comprises a guiding rail extending in a second direction; the second direction is vertical to the first direction; and the guiding rail is provided with a locating part; and a banknote box assembly provided with a second inlet/outlet at a top of the banknote box assembly and provided with two first movable parts arranged in movable fit with the two guiding rails respectively; wherein when the two first movable parts are in fit with the locating parts on the two guiding rails respectively after moving along the two guiding rails respectively, the banknote box assembly is in the cabinet and the second inlet/outlets is opposite to and in communication with the first inlet/outlet;

wherein the banknote box assembly comprises a frame and a banknote box installed in the frame; the two first movable parts are arranged on the two opposite sides of the banknote box, respectively; the second inlet/outlet is arranged on the top of the banknote box;

wherein one guiding part of the two guiding parts further comprises a sliding slot extending in the second direction; the banknote box assembly is further provided with a second movable part; the second movable part is arranged in movable fit in the sliding slot;

wherein the guiding part further comprises a first side wall, a second side wall, a third side wall and a fourth side wall connected in sequence; the first side wall, the second side wall and the third side wall jointly form the sliding slot; the guiding rail is arranged on the side of the fourth side wall away from the sliding slot; and the second side wall and the fourth side wall are arranged in a third direction at an interval, the third direction is vertical to the first direction and the second direction at the same time.

8. The cash recycling and processing device according to claim 7, wherein the locating part is a locating slot; the first movable part comprises a first roller; the first roller is provided with a circular slot for fitting with the guiding rail; the first roller is arranged in rolling fit with the guiding rail through the circular slot; when the first roller is in fit with the locating slot after rolling along the guiding rail, the banknote box assembly is in the cabinet and the second inlet/outlet is opposite to and in communication with the first inlet/outlet.

9. The cash recycling and processing device according to claim 7, wherein the locating part is a locating boss; the first movable part comprises a sliding block; the sliding block is provided with a slot for fit with the guiding rail; the sliding block is arranged in sliding fit with the guiding rail by the slot; when the sliding block is in fit with the locating boss after sliding along the guiding rail, the banknote box assembly is in the cabinet and the first inlet/outlet is opposite to and in communication with the second inlet/outlet.

10. The cash recycling and processing device according to claim 7, wherein the banknote box assembly comprises a frame and a banknote box installed in the frame; the two first movable parts are arranged on the two opposite sides of the banknote box, respectively; the second inlet/outlet is arranged on the top of the banknote box.

11. The cash recycling and processing device according to claim 10, wherein one guiding part of the two guiding parts further comprises a sliding slot extending in the second direction; the banknote box assembly is further provided with a second movable part; the second movable part is arranged in movable fit in the sliding slot.

12. The cash recycling and processing device according to claim 11, wherein the guiding part further comprises a first side wall, a second side wall, a third side wall and a fourth side wall connected in sequence; the first side wall, the second side wall and the third side wall jointly form the sliding slot; the guiding rail is arranged on the side of the fourth side wall away from the sliding slot.

13. The cash recycling and processing device according to claim 12, wherein the first side wall and the third side wall are arranged in the first direction at an interval; the second movable part is arranged in rolling or sliding fit with the first side wall and the third side wall at the same time when the second movable part is movably fitting with the sliding slot.

14. The cash recycling and processing device according to claim 11, wherein the second movable part comprises a second roller arranged on the frame; the second roller is in rolling fit with the first side wall and the third side wall at the same time.

15. The cash recycling and processing device according to claim 7, wherein the guiding rail is further provided with a slope; the slope is arranged to guide the first movable part to climb the guiding rail.

* * * * *